United States Patent [19]

Randall

[11] Patent Number: 4,511,003

[45] Date of Patent: Apr. 16, 1985

[54] SPRINKLER

[76] Inventor: Lowell N. Randall, 249 S. Miranda, Las Cruces, N. Mex. 88005

[21] Appl. No.: 518,759

[22] Filed: Jul. 29, 1983

[51] Int. Cl.[3] ..... A62C 37/10

[52] U.S. Cl. ..... 169/38

[58] Field of Search ..... 169/37–41

[56] References Cited

U.S. PATENT DOCUMENTS

| | | | |
|---|---|---|---|
| 447,004 | 2/1891 | Nagle | 169/39 X |
| 891,279 | 6/1908 | Martin | 169/39 |
| 2,510,756 | 6/1950 | Reger . | |
| 2,553,726 | 5/1951 | Rowley . | |
| 2,844,353 | 7/1958 | Gurries . | |
| 2,852,226 | 9/1958 | Wheatley . | |
| 3,075,738 | 1/1963 | Englund . | |
| 3,170,670 | 2/1965 | Johnstone . | |
| 3,291,445 | 12/1966 | Lundberg . | |
| 3,327,993 | 6/1976 | Elchyshyn . | |
| 3,446,286 | 5/1969 | Kreidler . | |
| 3,575,377 | 4/1971 | Carlton et al. . | |
| 4,088,301 | 5/1978 | Ehmig . | |
| 4,167,974 | 9/1979 | Job . | |
| 4,204,662 | 5/1980 | Reynolds . | |

*Primary Examiner*—Andres Kashnikow

*Attorney, Agent, or Firm*—Cushman, Darby & Cushman

[57] ABSTRACT

In an automatic fire sprinkler unit, the valve body is provided with an annular seat, e.g. of brass, against which a sealing disk of harder material, e.g. stainless steel normally is maintained resiliently, sealingly pressed by a compression strut which is interposed between the body and the sealing disk. The strut is intentionally subject to failure upon being heated to a predetermined extent. The unit is provided with a fulcrum which bears against the disk to vary the sealing area as more and less pressure is placed on the disk so that sealing pressure and compressive stress on the strut will be kept to minimum values. The unit is further provided with limit stop surfaces which prevent an overload, such as may result from dropping the unit while installing it, from doing hidden damage to the unit.

15 Claims, 17 Drawing Figures

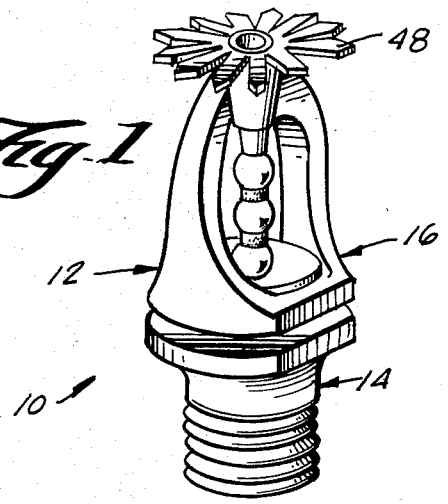
Fig. 1
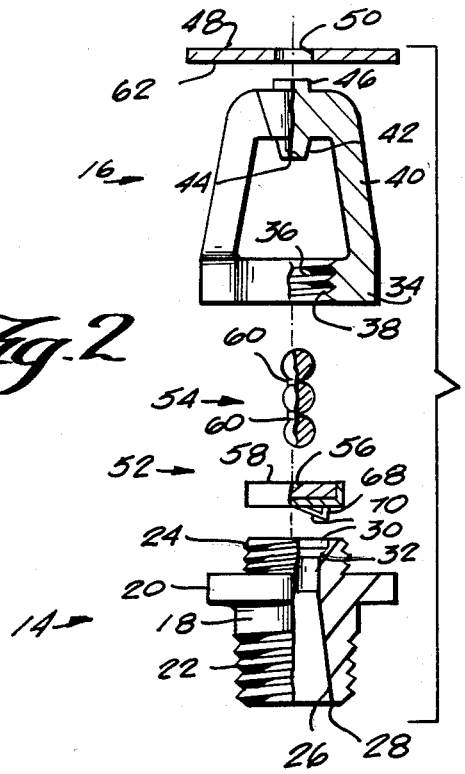
Fig. 2
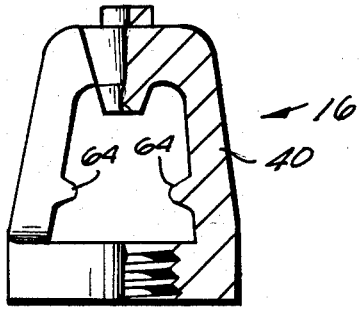
Fig. 3
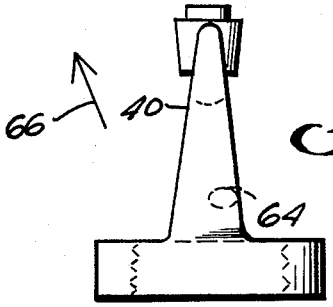
Fig. 4
Fig. 5
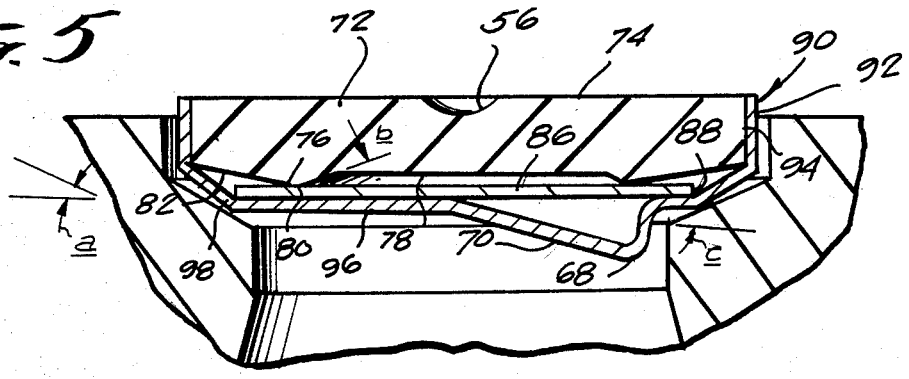

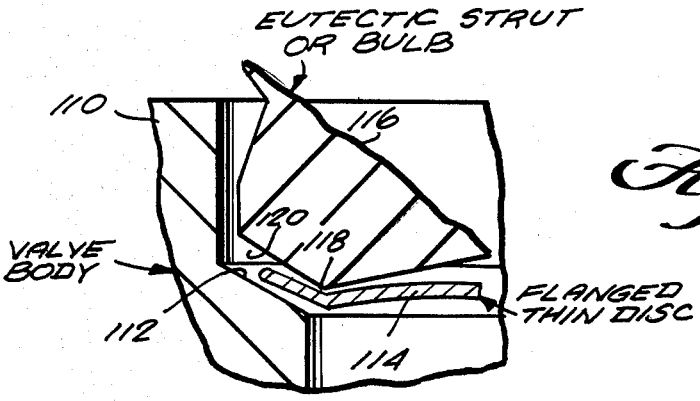
Fig. 6
NORMAL WORKING PRESSURE
Fig. 7
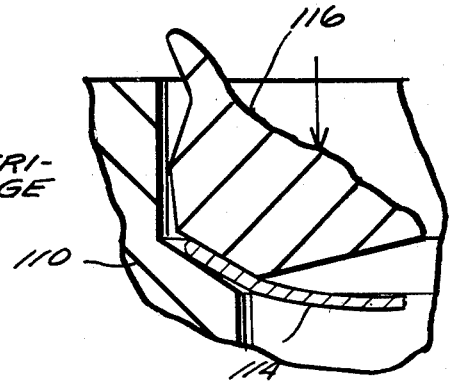
STRUT LOAD DISTRIBUTED OVER LARGE SEAL AREA
EXTERNAL OVERLOAD WITH ZERO INTERNAL PRESSURE
Fig. 8
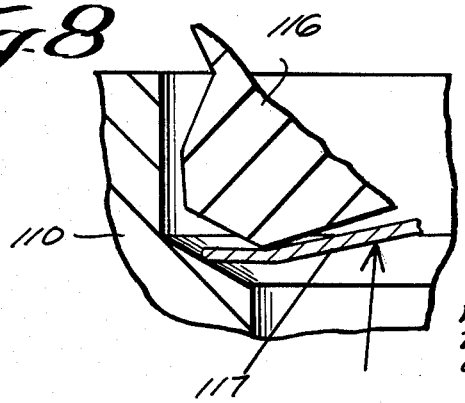
PRESSURE SURGE LIFTS STRUT, WHILE PRESSURE-BALANCED DISC MAINTAINS NEAR CONSTANT LOAD ON SEAL SURFACE

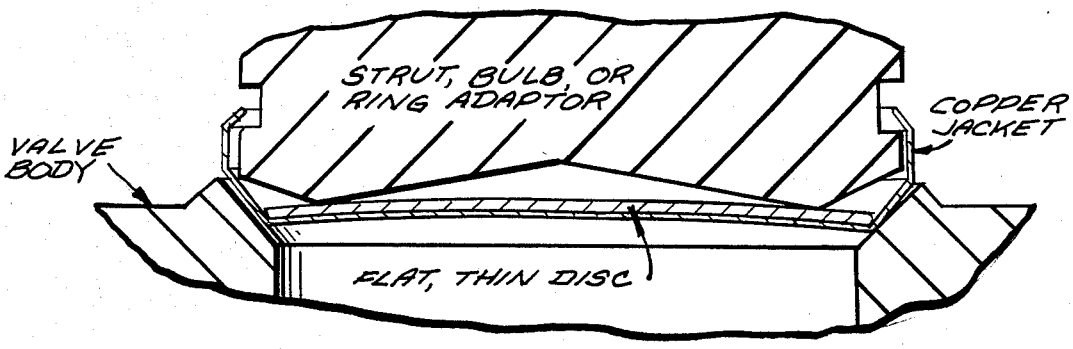
APPLIED TO THE TYPICAL KNIFE-EDGED SEAT TO SAVE RETOOLING COSTS
Fig. 9
Fig. 10
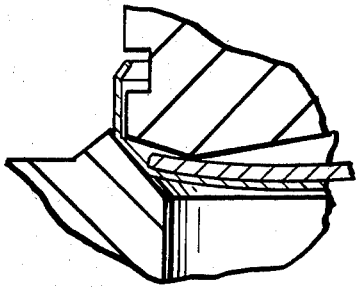
STRUT OVERLOAD IS TAKEN BY VALVE BODY
Fig. 11
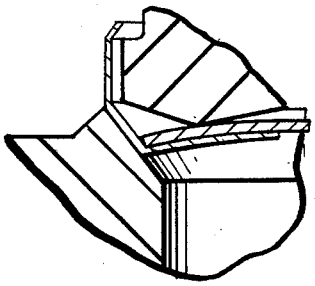
OVERPRESSURE LIFTS FULCRUM WITHOUT LOSS OF SEAL
Fig. 12
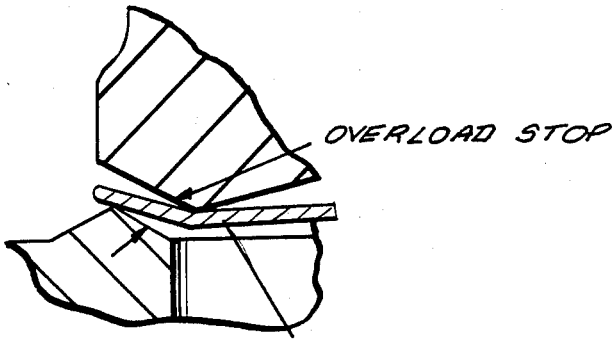

INVERTED SHALLOW DISH FLEX-DISC

SHALLOW FLANGE DISC WITH COPPER FOIL BOTH SIDES OF DISC

SHALLOW FLANGE DISC ATTACHED TO FULCRUM RING OF COPPER BY A COPPER JACKET

INTERNAL STOP

EXTERNAL STOP

SPRINKLER

BACKGROUND OF THE INVENTION

The building codes and fire safety codes of many political jurisdictions in the United States, as well as standard contract language provided as a practical necessity in many construction bidding situations, and many fire insurance policy terms require that the sprinkler units of the automatic fire sprinkler system of the building in question must be ones which are of a design which is certified as having passed the standard test of a specified independent testing laboratory. Although at present other testing laboratories are acting to attempt to obtain some significant proportion of the certification business, historically, and to the present, almost all of the certification has been done either by Underwriters Laboratories, Inc. or Factory Mutual. In any event the testing requirements and procedures of the different accepted testing organizations have many common features.

For automatic fire sprinkler units a typical testing requirement is that the unit have a resistance to structural failure from overload that is a stated multiple of its operational sealing pressure. Multiples of in the range of from seven to one up to ten to one are common. Accordingly, there is some incentive for the manufacturer to design automatic fire sprinkler units having low to moderate operational sealing pressures so as to avoid the need for the truly excessive mechanical strength that would otherwise be needed solely so the units would be able to pass the conventional certification tests. For operational sealing, the units must be capable of static loading, perhaps over a several-year time span punctuated by pressure fluctuations caused by water hammer, temperature variation and long term effects of seal galling, material creep.

A good design of automatic fire sprinkler should be economical to produce, easy to assemble, and not prone to being damaged in shipping and installation, and especially to not be prone to hidden damage that does not become manifest until the system incorporating the installed units is pressurized and placed in operation.

It has long been the practice for the manufacturers of automatic fire sprinkler units to provide machined, sharp, knife-like edges on the sprinkler body or frame as a seat for the seal. This is to provide a high unit stress load on the soft seal material with the lowest possible load applied to the eutectic strut or other heat-responsive actuator. Such light-duty stress loading of the eutectic strut or the like is a requirement placed on the manufacturer by fire insurance companies and underwriters. Light stress loads on both the seal material and the eutectic strut are highly desirable, as this reduces the fatigue rate of these components caused by stress corrosion and material creep over the long term life of the sprinkler.

Inherent with knife-edged seats are three disadvantages that lead to continuing problems for the manufacturer. First, and perhaps the most important, is the fact that the unit stress load at the knife edge tends to decrease with increasing internal fluid pressure.

Secondly, very little overload can be applied to the knife edge surface without danger of cutting through the soft seal material.

And finally, frequent tool sharpening is required in the manufacturing process to prevent tool chatter from causing defective seats.

Conventionally, in order to correct these problems, it has been necessary to apply a greater stress load than desirable to both the seal and eutectic strut or the like to insure against leakage due to pressure surges caused by water hammer and the like. Such increased seal and strut loads remain for the long life of the sprinkler although the need for increased loads may indeed be present for a very small fraction of the sprinkler life.

Also, knife-edged seats become a serious problem if the sprinkler frame suffers a blow of some sort during the handling and installation. The seal may become damaged in this process and not detected until water damage has occurred at its installed location.

Although these problems associated with knife-edged seals are well-known in the trade, the advantage provided by the small area (high unit load) seal contact in providing for the minimum strut loads has prolonged the use of this seal arrangement.

To fix these overload/underload problems, others have chosen to place springlike washers between the strut and seal surfaces, which reduces but does not eliminate these recurring problems.

SUMMARY OF THE INVENTION

In an automatic fire sprinkler unit, the valve body is provided with an annular seat, e.g. of brass, against which a sealing disk of harder material, e.g. stainless steel normally is maintained resiliently, sealingly pressed by a compression strut which is interposed between the body and the sealing disk. The strut is intentionally subject to failure upon being heated to a predetermined extent. The unit is provided with a fulcrum which bears against the disk to vary the sealing area as more and less pressure is placed on the disk so that sealing pressure and compressive stress on the strut will be kept to minimum values. The unit is further provided with limit stop surfaces which prevent an overload, such as may result from dropping the unit while installing it, from doing hidden damage to the unit.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

In the Drawings

FIG. 1 is a small scale perspective view of an automatic fire sprinkler embodying principles of the present invention;

FIG. 2 is an exploded front elevational view thereof with some portions broken away and longitudinally sectioned to expose internal details;

FIG. 3 is an exploded front elevational view with a portion broken away and longitudinally sectioned, of a modified form of the upper body member of the sprinkler of FIG. 1; and FIG. 4 is a side elevational view thereof;

FIG. 5 is a larger scale fragmentary longitudinal sectional view of the sprinkler of FIG. 1 showing details in the vicinity of the valve seat;

FIGS. 6, 7 and 8 are fragmentary longitudinal sectional views of a preferred embodiment of the sprinkler, showing details in the vicinity of the valve seat under three different conditions, namely: under normal working pressure, under external overload with no internal pressure, and under internal pressure surge;

FIGS. 9, 10 and 11 are fragmentary longitudinal sectional views similar to FIGS. 6, 7 and 8, respectively, but of a modified embodiment; and FIGS. 12–17 are fragmentary longitudinal sectional views similar to FIG. 6, but of respective modified embodiments.

DETAILED DESCRIPTION

Figure 13:
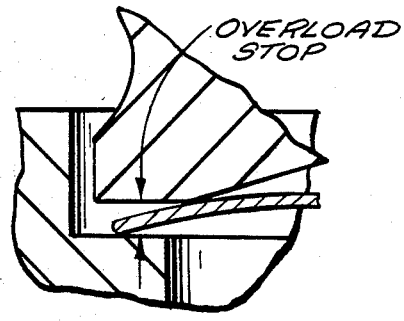

In FIGS. 1–5 there is shown a conceptual, teaching embodiment of the present invention. In practice, the principles of the invention can be put to use on sprinklers which are structured quite differently from what is shown in these Figures. However, the principles of the invention are well illustrated by this embodiment.

In FIG. 1 there is shown an automatic fire sprinkler unit 10. It would not be wrong to call this device simply a "sprinkler", or a "valve/nozzle member". Although the spatial orientation of the device 10 is preferably as shown in FIG. 1, the orientation shown is not essential to use of the principles of the invention, e.g. the unit 10 could be used in an inverted condition, or disposed at some oblique attitude. Accordingly, unless it otherwise appears to the contrary, descriptions of or relating to spatial orientation given in this text should be understood in a non-limitative sense and merely provided for convenience in description.

Merely looking at FIG. 1, one could not get much of an appreciation for the finer points of the invention. These will be introduced, hereinbelow, with reference first to FIG. 5. However the preceding figures may be reviewed in order to gain an understanding of broader aspects of the sprinkler.

Referring to FIGS. 1 and 2, the sprinkler 10 is seen to include a body 12, which in this particular instance (but not essentially), is made in two parts, including a lower or inner body member 14 and an upper or outer body member 16.

The inner body member 14 as shown is a tubular element 18 having an axially intermedially located, radially outwardly projecting, circumferentially extending boss or flange 20. Axially to one side of the flange 20, which shall be referred to herein as the "inner end", the tubular element 18 is provided with an external band of pipe threading 22. Axially to the other side of the flange 20, which shall be referred to herein as the "outer end" the tubular element 18 is provided with an external band of machine threading 24. The threading bands 22 and 24 respectively constitute means for screwingly connecting the sprinkler 10 to a supply of pressurized fire extinguisher fluid, e.g. liquid water at about 80–120 p.s.i., and means for screwingly connecting the inner body member 14 to the outer body member 16, i.e. for assembling the body 12. The inner body member 14 includes an axial throughbore 26 which includes an inlet opening 28 through the inner end of the inner body member 14 and an outlet 30 through the outer end of the inner body member 14.

An annular valve seat 32 is shown coaxially provided in the throughbore 26 near the outlet 30, adjacent and facing towards the outer end of the inner body member 14. By preference the inner body member is an integral casting, except that the threading 22, 24 is machined, and the valve seat 32 is machined by counterboring in through the outlet 30. By preference, the valve seat 32 is frusto-conically flared at a relatively large angle, up to ninety degrees, i.e. up to being essentially only radially extending, e.g. flat.

In this embodiment, a major reason for providing the body 12 in two, assemblable parts is that this makes it easier to machine the seat 32 inexpensively, yet accurately, so that it will be on center and substantially free of chatter marks, burrs and the like.

The other major component of the body 12, the outer body member 16 also preferably is an integral casting. It is shown including an axially short tubular element 34 having an axial throughbore 36 provided with a band of internal machine threading 38. On its outer end, the element 34 is shown integrally provided with an arch-like bail 40 which lies on a diameter of the element 34. Axially centrally, the bail 40 is coaxially provided with an axially inwardly projecting boss 42 having an axially inwardly opening detent recess 44 formed therein, and an axially outwardly projecting boss 46.

A sprocket-like spray deflector 48 is assembled to and fastened on the body outer member 16 by slipping the center hole 50 of the spray deflector 48 over the boss 46 and upsetting, e.g. peening the outer end of the boss 46.

The sprinkler unit 10 further includes a composite, disk-like valve member 52 and a heat-failing compression strut 54. An element of the valve member 52 includes means coaxially centrally providing an axially outwardly opening detent recess 56 in an axially outer face 58 thereof.

The sprinkler unit 10 is assembled by seating the valve member 52 on the valve seat 32, axially aligning the heat-failing compression strut 54 between the detent recesses 44 and 56, and screwing the inner and outer members 14, 16 of the body 12 together at 24, 38. A conventional joint compound such as that which is sold under the trademark Locktite can be used in the joint 24, 38 to prevent unintended unscrewing of the joint. In making up the joint, the strut 54 is placed under sufficient compression between the bail of the body 12 and the valve member 52 as to sealingly hold the valve member 52 against the valve seat 32 sufficiently to withstand the expected countering hydrostatic pressure when the device 10 is in service.

The assembled sprinkler 10 is placed in service by screwing its end 22 onto the end of a branch of a supply pipe for fire extinguisher fluid, e.g. liquid water.

In normal service, the compression strut 54 maintains the valve/nozzle unit in a closed condition. In the instance depicted, the compression strut 54 is constituted by a longitudinally extending series of small steel balls united by a small quantity of solder 60 fused between each two adjoining balls in the series. In the event that the unit 10 while in service is exposed to a predetermined excessive heat condition such as a fire, the solder 60 melts or at least softens so much as to lose its holding ability, the strut 54 disintegrates. At that moment, the pressure on the fire extinguisher fluid in the line blows the valve member 52 of the seat and out of the way. The fire extinguishing fluid then, issuing axially through the open valve strikes the inner face 62 of the deflector 48 and is broken-up or atomized thereby into a generally circular spray pattern of droplets which rain down to help douse the fire or help prevent its spreading to the vicinity of the particular sprinkler 10.

With some prior art sprinklers, a difficulty has been encountered, that when the valve member is blown loose from the valve seat it gets hung-up in the cage-like bail region of the body and stays there. Accordingly, much of the out-rushing water strikes the hung-up valve member and is deflected thereby, instead of striking the intended deflector. A non-uniform, unplanned-for spray pattern thus is provided by that sprinkler unit, to the end that some portion of the vicinity which is supposed to receive fire protection from the particular sprinkler unit is left unprotected thereby.

In the present disclosure, the present inventor shows two ways for overcoming that problem. These ways may be used together, or either may be used separately.

First, with reference to FIGS. 3 and 4, two nubs 64 are shown molded on the inner side of the bail 40 well below where the valve member might become hung up. These nubs 64 project medially and are offset to the left or to the right of the valve body diameter on which the bail 40 projects. See FIG. 4, where the nubs are seen to be offset to the right of center. Accordingly, as the valve member begins to blow away from the seat, it collides with and caroms off the eccentrically placed nubs 64, so that it leaves the body along the vector 66 before it can become hung-up.

Second, with reference to FIGS. 2 and 5, an element of the composite valve member 52 may be provided on the upstream-facing underside of the valve member 52, with an eccentrically-located protuberance 68 preferably having an obliquely-presented surface 70. The protuberance 68 is sufficiently centrally located that its presence does not interfere with the seating action of the valve member 54 on the valve seat 32, yet sufficiently eccentrically located and ramp-shaped that when the valve member 54 blows off the valve seat, the hydrodynamic action of the water on the surface 70 skids the valve member 54 toward one side, so that it leaves the body 12 along the vector 66 before it can become hung-up.

The valve member 52 and the region of valve seat 32 of the teaching embodiment of FIGS. 1–4 is shown in greater detail in FIG. 5. In FIG. 5, the disk-like composite valve member 52 is seen to include a relatively massive disk-like plate 72, e.g. made of brass. The plate 72 has the detent recess 56 formed on its upper face 74 and a ring-shaped sealing fulcrum 76 integrally coaxially provided on its lower face 78. The fulcrum 76 has an apex 80 formed by the juncture of a radially outer, sloped, e.g. frusto-conical surface 82 having a relatively shallow angle a of e.g. seven degrees, and a radially inner, sloped, e.g. frusto-conical surface 84 having a relatively shallow angle b of e.g. seven degrees. Accordingly, the fulcrum 76 is of but slight axial extent and the apex 80 is not so sharp or prominent as to be truly knife-like. The apex 80 is of somewhat smaller diameter than the minor diameter of the valve seat 32.

The valve member 52 further comprises a disk-like wafer 86 of stiffly resilient material, such as a flat stainless steel sheet, e.g. 0.010 inch thick. This wafer 86 is of a diameter intermediate the minor and major diameters of the valve seat 32, so that when the valve member 52 is installed, the outer peripheral edge 88 of the wafer 86 lies substantially radially beyond the apex 80 of the fulcrum 76 and overlies approximately the middle of the radial extent of the valve seat surface 32. In this example the valve seat surface 32 tapers at a steeper angle than the overlying radially outer surface 82 of the fulcrum 76, e.g. the angle c is thirty degrees.

The third and final element of the composite valve member 52 as shown in FIG. 5 is a cup 90, e.g. drawn of soft copper. The cup 90 has a sidewall 92 which frictionally embraces the radially outer wall 94 of the plate 72, so as to sandwich the wafer 86 between the fulcrum 76 of the plate 72 and the generally flat bottom wall 96 of the cup 90. (The bottom wall 96 is shown locally deformed at one site so as to provide the obliquely-presented protuberance 68.) Coaxially, radially between the sidewall 92 and the bottom wall 96, the cup 90 includes a circumferentially-extending, chamfered corner wall 98 of substantial axial and radial extent. The corner wall 98 is shown being slightly more steeply tapered than the sealing surface 32 and entirely overlying the sealing surface 32. Accordingly, as the device 10 is assembled, annular sealing contact of the valve member 52 with the valve seat 32 at the radially inner margin of the corner wall 98 of the cup 90, which coincides with the radially outer peripheral wall 88 of the resilient wafer 86. As the compression strut 54 centrally loads the plate 72, the fulcrum 76 is pressed against the wafer 86, resiliently flexing the wafer 86 so that its radially outer margin sealingly squeezes the interposed annular portion of the copper cup 90 against the valve seat 32.

Should the device 10 be subjected to an axial blow, while it is being shipped or installed, such as by being dropped in such an attitude that the valve member 32 is pressed with greater force towards the valve seat, the radially outer extent of the outer fulcrum surface 84 of the plate 72, which coicides with the radially outer margin of the corner wall 98 of the cup 90 moves axially toward the valve seat 32. Engagement, with the material of copper cup 90 interposed between them provides an overload stop to protect against such over-flexure of the wafer 86 that it will not thereafter resiliently press against the valve seat 32 with sufficient sealing force and to protect against gouging of the valve seat 32 by the outer peripheral margin of the wafer 86. This same structure is effective during certification laboratory mechanical shock testing of the device 10 to ensure that the device will withstand an axial overload equal to ten times the normal seating pressure.

An advantage of the provision of pressure-balanced valve member 52 is the ability of this member to maintain a sealing condition at high hydrostatic pressures even though the assembly torque may be quite low, e.g. three inch-pounds or less on the compression strut. Accordingly, the standby loads on the critical parts may be quite low, leading to avoidance of fatigue damage from commonly occurring pressure cycles. The structure shown also provides relatively high unit loading along the sealing annulus of contact between the valve member 52 and the valve seat 32. This is accomplished by the resilient counter deflection caused by fluid pressure on the underside of the wafer 86 through the bottom wall of the cup 90. As increasing pressure tends to d.ome the wafer 86 centrally outwards, the wafer 86 is resiliently flexed on the comparatively blunt apical region of the fulcrum 76 so that the radially outer margin of the wafer 86 tends to be resiliently pressed with a correspondingly greater force against the valve seat 32, with the soft material of the cup 90 remaining interposed between.

The valve member/valve seat design just described eliminates the need for knife edges at the sprinkler frame and provides for a constant or near constant unit loading on the seal independent of changes in internal fluid pressure magnitude. Also, the critical seal surfaces cannot be overloaded and damaged from any externally applied structural load short of structural failure of the sprinkler frame or strut.

In the seal arrangement of the sprinkler just described, the load on the strut is the minimum at all times and is dependent only on the degree of fluid pressure currently existing in the line. Thus, the load required to offset a pressure surge will be present only for the duration of the surge and not required over the long term.

Without departing from the principles of the invention, the cup 90 could be eliminated as a separate element, and the wafer 86 or valve seat 32, instead, plated or coated with copper or the like to provide the equivalent accommodation function. Likewise, the compression strut 54 may be replaced by comparable but differently-constructed members as are known in the art. One known alternative is a liquid-filled ampule or sealed vial. In the event of a fire or the like, expansion of the liquid and/or the build-up of pressure within the sealed vial due to vaporization of the liquid causes the vial to shatter and thus fail as a compression strut.

The structure depicted in FIGS. 1–5 may be varied or reconfigured somewhat without losing sight of the principles of the present invention.

The seal and stop surfaces can be either flat, conical, and/or spherical. The critical requirement to be met is that when fully seated from external loading, they become sufficiently parallel to provide the near constant stress/strain relationship desired. If flat when free, the flexible wafer 86 should be "dished" upward before loading so as to apply the first contact at the periphery of the flex disc.

The basic features may be further varied to achieve self-centering of parts during assembly, such as seat relief, and/or protrusion at the center of the disc to loosely fit the fluid exit nozzle.

The seat can be an integral part of the sprinkler frame or an inserted component. The fulcrum and stop surface can be an integral part of the eutectic strut or glass bulb, and/or be held together as an assembly.

An important feature of the device 10 as described, is that normally a comparatively small, comparatively small diameter annular area of the valve seat 32 is loaded in normal use to provide a watertight seal at the outer peripheral margin of the flexible disk 86. By keeping the outer diameter small, the stress load on the strut is truly extremely small. As the strut load is increased for any external loaded means, this small area seal is not cut because the surfaces in contact increase in area and diameter proportionately to the applied external load up to the point that the overload stop is engaged. Then a further load of several hundred pounds can be sustained without harmful plastic deformation of the sealing surfaces.

This feature has been most beneficial in allowing very high stress/strain loads to be initially applied during assembly. This load in practice can be sufficient to cause a small amount of "plastic set" in all components in the frame and strut assembly, as well as forcing sufficient plastic set in the soft seal material to conform to seat defects of manufacture. Once this has been accomplished, this initial "plastic strain load" can be reduced to the very low net loading required at the seal. Such action so reduces the long term material "creep" of the whole sprinkler assembly as to be no longer considered a problem.

Some variations on the structure described hereinabove with regard to FIGS. 1–5 are described hereinbelow with regard to FIGS. 6–17. (In these views bends, thicknesses, etc., are exaggerated for convenience in illustration.)

A simple form of construction is shown in FIGS. 6–8, where the sprinkler body 110, made of brass, bronze, high temperature-withstanding synthetic plastic material or the like forms a valve seat 112 against which the harder material, e.g. stainless steel or the like, of the flexible disk 114 annularly seals. The frangible glass bulb or eutectic strut 116 is configured at its base to provide the fulcrum at 118 and the limit stop at 120. FIG. 6 shows this embodiment of the device in use at normal pressure, e.g. the line pressure of the water against the inner face of the flexible disk is about 80–120 p.s.i.g. FIG. 7 shows the typical temporary reconfiguration of the surfaces when the device 110 is subjected to a severe external overload, such as might occur were the sprinkler 110 dropped to the floor from a ladder as a worker was installing it. And FIG. 8 illustrates the configuration of the flexible disk and fulcrum action when the sprinkler is subjected to a water pressure surge of, for instance, 1000 p.s.i.g. or more.

If the body of the automatic fire sprinkler unit is made in one main piece, rather than in two main pieces as in FIGS. 1–5, then a compression adjustment screw (not shown) would be axially provided centrally in through the outer end of the bail, as is conventional, the inner end of this screw would provide the detent recess for the outer end of the compression strut. Thus by torqueing such an adjustment screw, one can apply the desired degree of compressive loading on the valve member via the compression strut.

The normal strut load at time of assembly is, for instance, about 80 lbs. and is achieved with a torque of 4 inch/lbs. on the screw, after which the adjustment screw is treated with a thread lock compound to prevent the screw from being turned thereafter.

The normal fluid working pressure ranges from 80 to 150 p.s.i.g. but the seal is generally tested to 800 p.s.i.g. at time of manufacture as a safety factor in insuring that any specimen can pass the laboratory test of 3000 cycles in surge pressures, each cycle consisting of going from 50 to 500 p.s.i. over a one-second period.

Typically, the seal of one of the sprinklers of the present invention requires only 1 inch/lb. torque, after setting at 4 inch/lbs. or higher, to hold static pressures of over 2000 p.s.i.g. Thus, a large margin of safety exists with the recommended 4 inch/lbs. torque at time of manufacture.

The unique overload stop of the fulcrum ring places the force over such a large seal area that no damage is done to the soft copper seal by the relative edge of the disc.

Some testing laboratories drop a weight equal to that of the sprinkler assembly from a height of 3 feet with the sprinkler setting upright on a steel plate. The force of impact is such as to cut clear through the copper gasket in conventional designs. The testing laboratories do not fault a sprinkler that visually fails such as the bulb bursting or the strut assembly flying all apart. Only if the damage is not apparent from visual inspection. The glass never fails this test and in other specifications must be capable of withstanding a static load roughly 10 times that of the static strut load at time of assembly. The bulb in a typical specimen of the sprinkler most likely would fail under a static load somewhere between 1000 and 1200 lbs. (force, not pressure). Thus, the device of the invention provides a large safety factor for passing the assembled strut load tests.

Various angles for surfaces in the fulcrum/seal region on several models tested in the course of development of the present invention all appear to work equally well. Shallow or flat angles do not self-center during assembly and need other means to guide them into proper position of the seal surfaces, as shown in some of the alternate designs that follow. Otherwise, the only criteria is for the fulcrum stop to engage parallel to the valve body if the stop area is inside the seal circle, or engage the valve body first if the fulcrum stop is outside the seal surface circle—i.e. before the stop strikes the seal area.

The configuration in FIGS. 6–8 is preferred for the reason that the seal surfaces are self-centering, plus the fact that this design is the simplest to maintain quality control during manufacture. For cost reasons the FIGS. 6–8 design, using the edge of the hard disk directly against a softer seat of the valve body is preferred. However because the long-term corrosion effect of stainless steel against brass is an unknown quantity in the automatic fire sprinkler market, whereas copper to brass has been used successfully for the past 50 years, some users may prefer the FIGS. 1–5 design. In all testing by the present inventor, the stainless steel disk (302 full hard) of FIGS. 6–8 seems to perform as well as the copper seal of FIGS. 1–5 against a brass body.

In a typical embodiment of the present invention, the fulcrum is placed at a diameter of 0.375±0.010 and recedes at an angle of 30±1° (120° included). This matches the valve seat of 30°±1°. The seal area is at the outer edge of the 0.470" diameter 0.010" thick stainless steel disk (302 full hard), preshaped at time of punching to spring back to angle of 25° from the 0.375 diameter of the fulcrum. These values for fulcrum diameter and disk thickness were determined experimentally. Disk thicknesses over 0.012" were found to not work very well in preventing leakage during pressure surges above 500 p.s.i. while thinner than 0.010" disk took a permanent set after overpressure. A disk diameter of 0.470 was selected to be as near the 0.412 diameter fluid nozzle opening as practical for an inside stop arrangement. A larger diameter would work just as well or better, but would require higher static loads on the strut that the present inventor has wished to avoid.

These number values are merely exemplary and would all need change when fitting the idea to a different strength valve body with other sized openings and are submitted in answer to your questions about the specific working model.

Here are some general rules which the present inventor suggests be followed when practicing the present invention.

The thickness, flexibility, hardness and elastic strength all play an important part in selecting the corrosive resistant material to be used as a flexible disk.

The ratio of the seal diameter to the fulcrum diameter is critical and varies with frame strength and disk thickness; it is best determined empirically.

The initial shape of the disk is critical; the disk must be capable of sufficient spring force when initially loaded to effect a seal, yet not be so stiff as to damage the seal before the fulcrum motion is stopped from overload or leaks occur from overpressure.

In practice, the designer should take the first try from stress and strain calculations, using known properties of the sprinkler frame, with finalized numbers being obtained empirically in actual test of the design. It will be seen in the figures that follow that the disk shape must be matched to the valve seal and fulcrum stop to achieve this end. The preshaped disk may take the shape of deep flange, shallow flange, shallow inverted dish, and/or flat disk, depending on the seal arrangement selected. Nevertheless, the above design criteria should be applied.

The flexible disk can double as the seal, but must be significantly harder than the valve body, such as stainless steel with brass, bronze or high temperature plastic used for the valve seat. Conceivably, Monel metal and/or phosphor bronze will also perform as a disk just as well.

Figure 14:
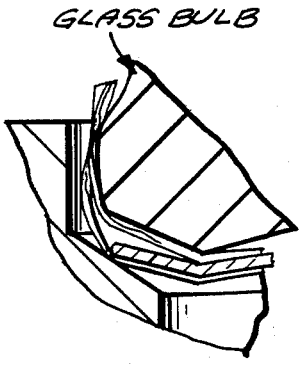
Figure 15:
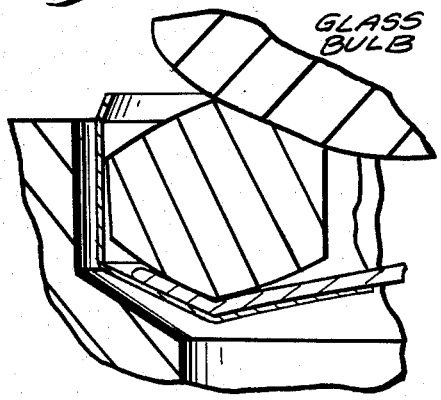
Figure 16:
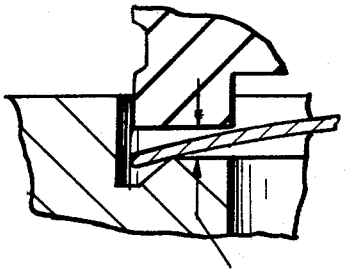
Figure 11:
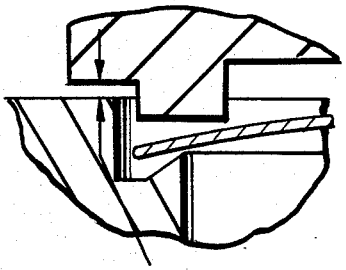

The flexible disk can be fastened to the fulcrum by a jacket of copper foil (FIG. 15) and/or sandwiched between two layers of foil to protect the glass bulb such as shown in FIG. 14. The disk could be coated with teflon and/or copper-plated to serve as a seal material softer than the sprinkler body and to protect against early bulb fatigue because of stress concentrations at the interface.

In the case where a separate fulcrum ring is used to interface the disk and the strut or bulb, the fulcrum ring can be made of copper or brass. Hard copper is preferred because it is still soft enough to conform to a glass bulb if initially loaded to 10 inch/lbs. torque, then backed off to the desired static frame load of 4 inch/lbs. torque. By this method, the greater useful life of the bulb is assured.

As for the method of manufacture in the FIGS. 1–5 embodiment, a punch press is used to draw a deep copper cup. Into this cup goes a preshaped and punched disk of stainless steel with the burr side up (away from the copper seal side). Next, a preshaped fulcrum ring, cut and stamped from a continuous half-inch coil of No. 11 copper wire, is dropped into the copper cup. Then the whole assembly is forced through a die that shears off the excess copper and forces it over the fulcrum ring, much as a bottle cap is attached to a soft drink bottle.

Some noteworthy features of the constructions shown in FIGS. 6–17 are indicated by legends on these figures.

It should now be apparent that the sprinkler as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A sprinkler, comprising:

a body having a bore with an inlet and an outlet;

surface means circumferentially providing an annular valve seat in said bore of said body;

a disk-like valve member constructed and arranged to be normally held in resilient, circumferential sealing engagement with said valve seat;

a heat-failing compression strut having two opposite ends;

bail means provided on said body for retaining said compression strut in compression against the valve member in a sense to urge the valve member into circumferential sealing engagement with said valve seat, with the compression strut having one end bearing against the bail and the other end bearing against the valve member;

means acting between said strut and said body for adjusting the amount of sealing force applied by the strut to the valve member;

said disk-like valve member including a disk-like stiffly resilient wafer having a central region, an annular radially intermediate region, and an outer peripheral margin with an outer edge, said wafer having an inner side facing upstream and an outer side facing externally;

said wafer outer peripheral margin being arranged to circumferentialy, resiliently, sealingly bear against said valve seat;

said wafer central region being arranged to face upstream pressure such that increasing pressure on the wafer central region tends to resiliently dome said wafer;

fulcrum means arranged to annularly bear against said wafer radially intermediate region, against the outer side of said wafer, so that as increasing upstream pressure tends to dome said wafer central region, said wafer outer peripheral margin tends to pivot about said fulcrum means for increasing the force and area of sealing contact between the valve member and the valve seat; and stop means constructed and arranged to limit axial movement of the fulcrum means in the upstream direction to a predetermined amount and thus prevent application of excessive force to the peripheral margin of the wafer.

2. The sprinkler of claim 1, wherein:

the valve member further includes a layer of copper interposed between the wafer and the valve seat.

3. The sprinkler of claim 2, wherein:

the wafer is made of stainless steel.

4. The sprinkler of claim 1, wherein:

the valve member is a composite member including a two-faced disk-like plate having one face directly engaged by said other end of the compression strut, and having the other face thereof provided with said fulcrum means.

5. The sprinkler of claim 4, wherein:

said valve member further includes a soft cup containing the wafer and at least partly enclosing the plate and uniting the wafer to the plate.

6. The sprinkler of claim 5, wherein:

the soft cup is made of copper.

7. The sprinkler of claim 4, wherein:

said stop means is constituted by generally parallel, generally axially oppositely-facing, confronting surfaces on said plate and said body.

8. The sprinkler of claim 1, wherein:

said fulcrum means is provided directly on said other end of said compression strut.

9. The sprinkler of claim 1, wherein:

said stop means is constituted by generally parallel, generally axially oppositely facing, confronting surfaces on said other end of said compression strut and said body.

10. The sprinkler of claim 9, wherein:

said stop means is located radially inwardly of where said valve member normally is held in resilient circumferential sealing engagement with said valve seat.

11. The sprinkler of claim 9, wherein:

said stop means is located radially outwardly of where said valve member normally is held in resilient circumferential sealing engagement with said valve seat.

12. The sprinkler of claim 1, wherein:

said stop means includes a portion of said valve seat lying radially adjacent to where said valve member normally is held in resilient circumferential sealing engagement with said valve seat.

13. The sprinkler of claim 1, further including:

means for applying a lateral force to the valve member as the compression strut fails due to heat and the valve member is blown generally axially away from the valve seat, for ejecting the valve member from the body along an oblique path.

14. The sprinkler of claim 13, wherein:

said lateral force applying means comprises ramp-like surface means eccentrically provided on the upstream side of the valve member.

15. The sprinkler of claim 13, wherein:

said body includes a tubular main portion having said bail arching therefrom along an axial projection of a diameter thereof, said lateral force applying means comprising medially directed protuberance means formed on said bail intermediate the axial extent thereof, said protuberance means being offset to one side of said axial projection of said diameter.

* * * * *